US010122062B1

(12) United States Patent
Sorbel et al.

(10) Patent No.: US 10,122,062 B1
(45) Date of Patent: Nov. 6, 2018

(54) CRESCENT RING RESONATOR

(71) Applicant: NORTHROP GRUMMAN SYSTEMS CORPORATION, Falls Church, VA (US)

(72) Inventors: Scott R. Sorbel, Redondo Beach, CA (US); Vincent M. Ortiz, Hermosa Beach, CA (US)

(73) Assignee: Northrop Grumman Systems Corporation, Falls Church, VA (US)

( * ) Notice: Subject to any disclaimer, the term of this patent is extended or adjusted under 35 U.S.C. 154(b) by 97 days.

(21) Appl. No.: 15/345,191

(22) Filed: Nov. 7, 2016

(51) Int. Cl.
*H01P 7/08* (2006.01)
*H01P 7/10* (2006.01)

(52) U.S. Cl.
CPC ..... *H01P 7/082* (2013.01); *H01P 7/10* (2013.01)

(58) Field of Classification Search
CPC ..... H01P 7/10
USPC ..... 333/219
See application file for complete search history.

(56) References Cited

U.S. PATENT DOCUMENTS

| | | | |
|---|---|---|---|
| 8,097,854 | B2 | 1/2012 | Nagel |
| 8,493,276 | B2 | 7/2013 | Greegor et al. |
| 8,711,897 | B2 | 4/2014 | Miles |
| 8,780,010 | B2 | 7/2014 | Sanada |
| 2011/0287218 | A1 | 11/2011 | Narimanov |
| 2012/0057616 | A1 | 3/2012 | Padilla et al. |
| 2015/0138009 | A1 | 5/2015 | Liu et al. |
| 2015/0303870 | A1 | 10/2015 | Poddar et al. |

FOREIGN PATENT DOCUMENTS

KR 10-1521211 B1 5/2015

OTHER PUBLICATIONS

Gong, et al. "High-Q Resonators and Filters Inside Advanced Low-Temperature Co-Fired Ceramic Substrates Using Fine-Scale Periodicity", IEEE Transactions on Microwave Theory and Techniques, vol. 56, No. 4, Apr. 2008, pp. 922-929.*
Atre, Ashwin C. et al. "A Broadband Negative Index Metamaterial at Optical Frequencies" Advanced Optical Materials, Adv. Optical Mater, 2013, pp. 327-333.

(Continued)

*Primary Examiner* — Benny Lee
*Assistant Examiner* — Hafizur Rahman
(74) *Attorney, Agent, or Firm* — John A. Miller; Shumaker, Loop & Kendrick, LLP

(57) ABSTRACT

A metamaterial resonator structure having a size for resonating a predetermined frequency band. The resonator structure includes one or more dielectric slabs each having a top surface and a bottom surface. A conductive resonator element is configured on the top surface of each dielectric slab and has a crescent shape including a center portion and opposing rounded end portions defining a gap therebetween, where the center portion has a wider dimension then the end portions so that a width of the element gradually tapers from the center portion to the end portions, and where the conductive element has a diameter that is a fraction of a wavelength of the frequency band. Several dielectric slabs can be stacked on top of each other, where each slab has a different size and each conductive resonator element is a different size so that each resonator resonates a different portion of the frequency band.

18 Claims, 2 Drawing Sheets

(56) References Cited

OTHER PUBLICATIONS

Abutahoun, Nidal et al. "A Crescent Shaped Split Ring Resonator to From a New Metamaterial" International Journal of Engineering and Technology, vol. 2, No. 10, Oct. 2012, pp. 1702-1706.
Watts, Claire M. et al. "Metamaterial Electromagnetic Wave Absorbers" Advanced Optical Materials, Adv. Mater, 2012, pp. OP98-OP120.
Cheng, Yongzhi et al. "Perfect Metamaterial Absorber Based on Split-Ring-Cross Resonator" Applied Physics A Materials Science & Processing, 2011, pp. 99-103.
Landy, N. I. et al. "A Perfect Metamaterial Absorber" Paper, [cond-mat.mes-hall], Mar. 11, 2008, pp. 1-6.
Marques, R. et al. "Left-Handed-Media Simulation and Transmission of EM Waves in Subwavelength Split-Ring-Resonator-Loaded Metallic Waveguides" Physical Review Letters, vol. 89, No. 18, Oct. 28, 2002, pp. 183901-1-183901-4.

* cited by examiner

CRESCENT RING RESONATOR

BACKGROUND

Field

This invention relates generally to a metamaterial electromagnetic wave absorber that includes a crescent ring resonator and, more particularly, to a metamaterial electromagnetic wave absorber that includes at least one crescent ring resonator element having rounded end tips, where several of the absorbers can be stacked on top of each other to provide a broadband absorber structure.

Discussion

There are many applications for electromagnetic wave absorbers that absorb and/or redirect electromagnetic radiation at a particular frequency band of interest. For example, electromagnetic wave absorbers can be provided on structural elements, such as I-beams in a building, so that electromagnetic radiation from cell phones or other devices is directed around the structural element and is not undesirably scattered by the element.

One type of known electromagnetic wave absorber is a resonant absorber that causes incident electromagnetic radiation to resonate at a specific frequency, which causes energy at that frequency to be absorbed by the absorber and converted to heat so that the absorber does not reflect, scatter or transmit the radiation at that frequency. These types of resonant absorbers employ various configurations of conductive elements having certain sizes relative to the wavelength of interest so as to create desirable electromagnetic coupling and resonance.

One type of resonant electromagnetic wave absorber is known as a metamaterial absorber, which are typically arrays of structured sub-wavelength elements having a certain electric permittivity and magnetic permeability, and that can achieve a negative index of refraction. Metamaterials that are designed to be absorbers offer benefits over conventional absorbers such as miniaturization, wider adaptability and increased effectiveness. One known metamaterial absorber employs an array of resonator unit cells each having a split conductive ring formed on a dielectric substrate. Incident electromagnetic radiation at a certain frequency induces a current flow in the conductive ring in each unit cell that resonates across a gap between ends of the ring.

DETAILED DESCRIPTION OF THE EMBODIMENTS

The following discussion of the embodiments of the invention directed to a metamaterial crescent ring resonator absorber is merely exemplary in nature, and is in no way intended to limit the invention or its applications or uses.

As discussed above, metamaterial spilt ring resonators that absorb electromagnetic radiation at a particular frequency band of interest are known in the art. The present invention proposes improvements to the split ring resonator design by reconfiguring the conductive element of the resonator to have a specific crescent-shape that is operable to improve frequency resonance and the electric permittivity and magnetic permeability of the absorber for both narrowband and broadband applications.

Figure 1:
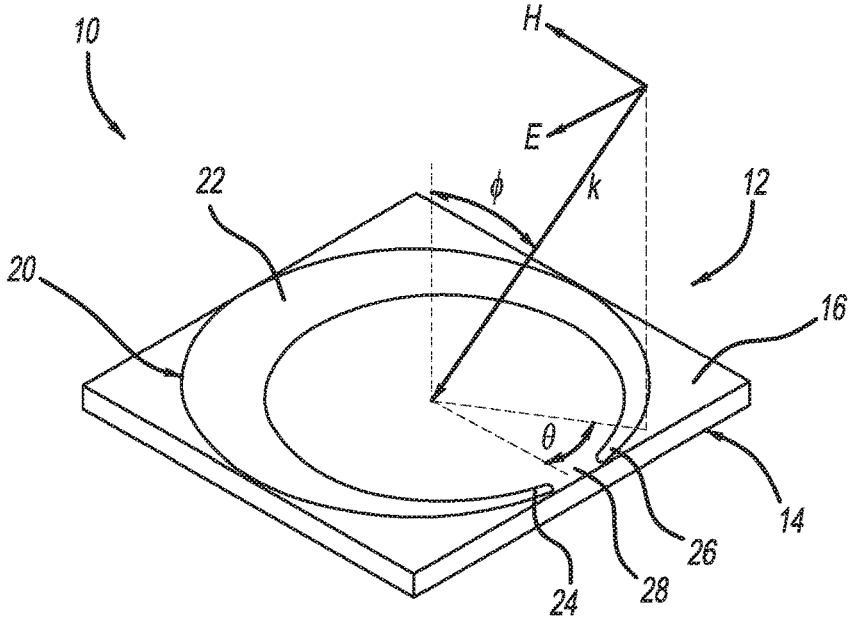
FIG. 1 is an isometric view of a unit cell for a metamaterial crescent ring resonator absorber.

FIG. 1 is an isometric view of a metamaterial absorber unit cell 10 that includes a crescent ring resonator 12 having a dielectric slab 14 including a top surface 16 on which is deposited a specially configured crescent-shaped conductive element 20. The element 20 can be deposited on the surface 16 of the slab 14 by any suitable process, such as photolithography. As will be discussed in detail below, the resonator 12 is configured to resonate at a particular frequency band of interest having a wavelength $\lambda$. The resonator 12 has a size designed for a metamaterial absorber, where the conductive element 20 has a width that is typically in the range of $\lambda/8$-$\lambda/20$. The dielectric slab 14 can be any dielectric suitable for the purposes discussed herein, such as various ceramic materials. For example, certain fine grained ceramics that have the form of nanofibers or nanotubes offer certain advantages. Other suitable materials include aluminum oxide, zirconium oxide, silicon nitride, etc. It is noted that in this embodiment, the dielectric slab 14 has a square shape, however, this is by way of a non-limiting example in that the slab 14 can have any shape for a particular application, such as hexagonal, rectangular, triangular, circular, etc.

The conductive element 20 includes spaced apart tips 24 and 26 defining a gap 28 therebetween. A center portion 22 of the element 20 has a wider dimension than the tips 24 and 26, as shown, to give the element 20 its crescent shape, where the width of the element 20 gradually tapers from the center portion 22 to the tips 24 and 26. Electromagnetic waves that propagate through the unit cell 10 at the frequency for which the resonator 12 is designed for creates a current flow in the element 20 that oscillates back and forth between the tips 24 and 26 at the resonant frequency, which causes the energy at that wavelength to be absorbed by the unit cell 10. More specifically, the magnetic field vector in the electromagnetic wave induces a current flow in the conductive element 20 as the waves propagate. Capacitive coupling between the tips 24 and 26 across the gap 28 allows the conductive element 20 to support resonant wavelengths that are larger than the diameter of the element 20 by producing a large capacitance value that lowers the resonant frequency. An electric field builds up as a result of the charge at the gap 28 that counteracts the circular current causing energy to be stored in the vicinity of the gap 28 and magnetic field energy concentrated in the region enclosed by the element 20.

FIG. 1 shows a wave vector k of the electromagnetic wave, which is $2\pi/\lambda$, and the orientation of the E-field and the H-field for the wave vector k. The angle $\Phi$ is the angle between the vector k and the Z-axis and the angle $\theta$ is the angle between the X-axis and the plane of incidence in the X-Y plane.

As is apparent, the tips 24 and 26 are rounded, which operates to increase the absorption frequency band of the resonator 12. Particularly, the rounded tips 24 and 26 allow the field coupling across the gap 28 to be increased, which allows a wider bandwidth. Further, the taper of the width of the element 20 from the center portion 22 to the tips 24 and 26 also affects the signal propagation in the element 22, which also operates to increase the absorption frequency band of the resonator 12. Those electromagnetic waves that impinge the unit cell 10 normal to the surface 16 at the frequency band of interest are absorbed by the unit cell 10, but better absorption capabilities are typically provided if the angle of incidence of the waves is oblique to the surface 16.

Figure 2:
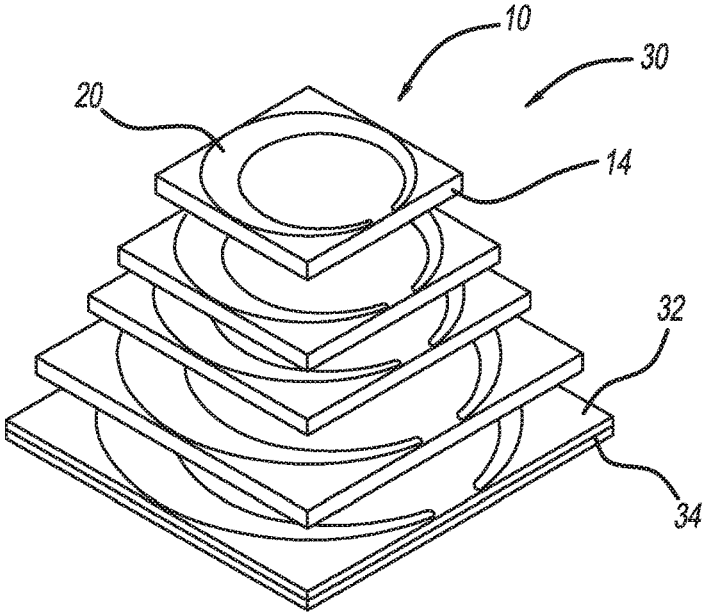
FIG. 2 is an isometric view of an absorber structure including a stack of metamaterial crescent ring resonator unit cells.

As discussed above, the unit cell 10 is operable to absorb radiation over a certain frequency band. Typically that frequency band is relatively narrow. Therefore, it is desirable to increase the absorption band of the absorber by combining multiple metamaterial unit cells together. FIG. 2 is an isometric view of an absorber structure 30 including several of the unit cells 10 stacked on top of each other, where each unit cell 10 operates at a different frequency band. Particularly, each of the unit cells 10 has a different size and a different sized resonator 12 designed for a different frequency band for that unit cell 10.

The thickness of the dielectric slab 14 is selected based on the particular application and the frequency band being absorbed. More particularly, the thickness of the slab 14 is selected so as to prevent a short circuit between the conductive elements 20 in the stack of the cells 10, but still allowing some electromagnetic coupling therebetween. For example, the electromagnetic coupling between the conductive elements 20 of different unit cells 10 operates more efficiently if the distance therebetween is less than the wavelength λ. In one non-limiting embodiment, the thickness of the slab 14 is in the range of 5-200 μm. Each dielectric slab 14 can be a single layer or multiple layers, where one of the slabs 14 is shown including multiple layers 32 and 34 to illustrate the multiple layer embodiment. Any suitable mix and match of single layers or multiple layers can be provided in the structure 30, such as the layers 32 and 34 can be of different dielectrics, can have different thickness, can be more layers than just two layers, etc. One advantage of multiple layers could be graded index of refraction that would allow further control over the transmissibility of the material. Further, it is noted that the diameter of the element 20 is such that an edge of the element 20 generally aligns with an edge of the slab 14, which is desirable to provide better electromagnetic coupling with the conductive element 20 adjacent to it.

The structure 30 is configured so that the largest unit cell 10 is at the bottom, where the size of the unit cells 10 gradually decreases towards the top of the structure 30, as shown. It is desirable to have the largest unit cell 10 at the bottom of the structure 30 farther from where the incident radiation impinges the structure 30 because signals having lower frequencies and longer wavelengths typically penetrate structures more deeply. Since each of the unit cells 10 is able to absorb radiation at different frequency bands, the combination of the unit cells 10 can be designed to absorb continuous frequency bands so that the structure 30 is able to absorb a larger bandwidth.

It is noted that the unit cells 10 are spaced apart in FIG. 2. This is merely for illustration purposes where the unit cells 10 would be stacked directly on top of each other. It is further noted that in this non-limiting embodiment, the structure 30 includes five of the unit cells 10. However, in a practical implementation, the number of the unit cells 10 could be significantly more, where the height of the structure 30 would be dependent on the particular frequencies.

Figure 3:
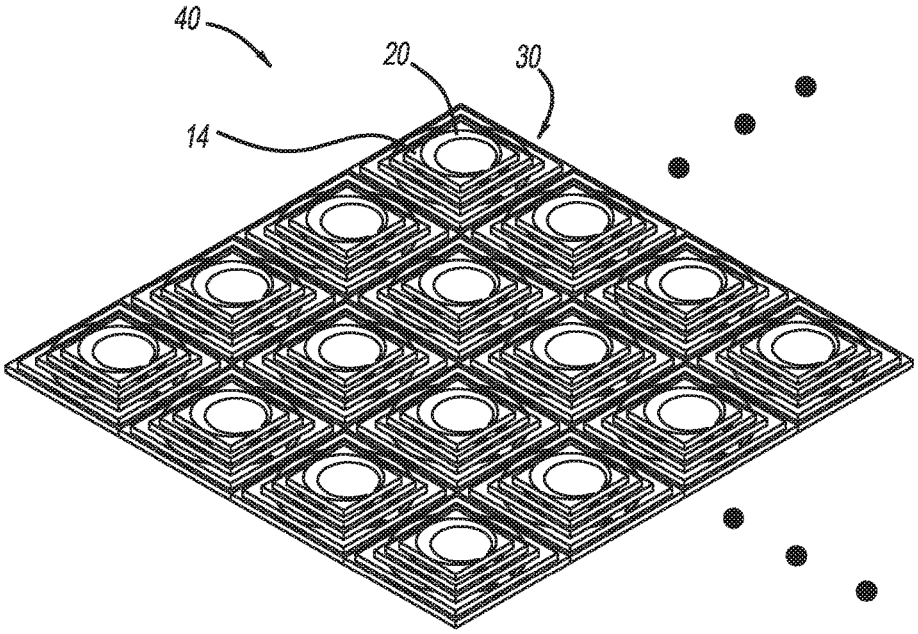
FIG. 3 is an isometric view of an array of stacked metamaterial crescent ring resonator absorbers.

As mentioned above, the width dimension of the unit cells 10 is generally between λ/8-λ/20. However, in order for the absorber to be effective, the size of the absorber needs to be at least as wide as the wavelength λ of interest, and preferably about 2λ wide. FIG. 3 is an isometric view of a metamaterial resonator absorber array 40 including a plurality of the structures 30 positioned side by side, as shown. The number of the structures 30 that is selected depends on the width of the unit cells 10, where the combined size of the array 40 in the X and Y direction is at least 2λ of the longest wavelength absorbed by the bottom unit cell 10.

Figure 4:
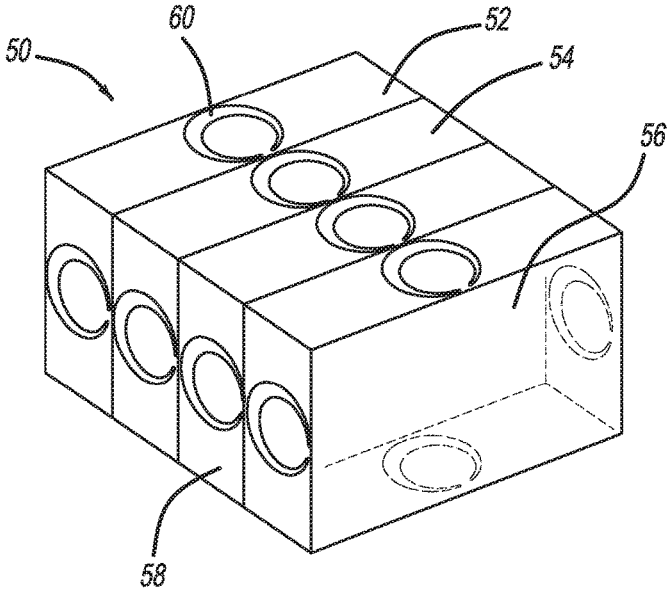
FIG. 4 is an isometric view of an electromagnetic waveguide including crescent ring resonators on four sides.

Metamaterial absorbers can come in various shapes and configurations. FIG. 4 is an isometric view of a metamaterial crescent ring resonator waveguide 50 including a plurality of unit cells 52 positioned adjacent to each other, where each unit cell 52 includes a dielectric slab 54 having a front face 56 through which the waves propagate and four side walls 58. In this design, each of the side walls 58 of the slabs 54 includes a crescent ring resonator 60 of the same type as the resonator 12. An electromagnetic signal propagating through the waveguide 50 interacts with the resonators 60 in the manner discussed above so that those wavelengths λ of the signal that are not desirable are absorbed by the waveguide 50. Because the resonators 60 on perpendicular side walls 58 are oriented perpendicular to each other, they operate to absorb wavelengths of electromagnetic radiation having perpendicular polarizations.

Although the discussion above talks about a metamaterial structure for absorbing certain wavelengths of radiation, in an alternate embodiment, the absorber can be used to redirect the resonating wavelengths by changing the index of refraction of the dielectric slab 14 so that electromagnetic radiation at those frequency bands is routed around certain objects, such as structural elements in a building.

The foregoing discussion discloses and describes merely exemplary embodiments of the present invention. One skilled in the art will readily recognize from such discussion and from the accompanying drawings and claims that various changes, modifications and variations can be made therein without departing from the spirit and scope of the invention as defined in the following claims.

What is claimed is:

1. A metamaterial resonator structure having a size for resonating a predetermined frequency band, said structure comprising:

at least one dielectric slab having a top surface and a bottom surface; and at least one conductive resonator element configured on one of the surfaces of the at least one dielectric slab, said conductive element having a crescent shape including a center portion and opposing rounded end portions defining a gap therebetween, wherein the center portion has a wider dimension than the end portions so that a width of the element gradually tapers from the center portion to the end portions, and wherein the dielectric slab has a thickness that is less than a wavelength of the frequency band, and wherein the at least one dielectric slab is a plurality of dielectric slabs each including a conductive resonator element configured on the top surface of the slab so as to define a stack of the slabs, wherein each slab and each conductive element has a different size so that each conductive element resonates at a different frequency band, and wherein the plurality of dielectric slabs are configured so that a largest size dielectric slab is positioned at a bottom of the structure and the slabs decrease in size to a top of the structure.

2. A metamaterial resonator structure having a size for resonating a predetermined frequency band, said structure comprising:

at least one dielectric slab having a plurality of surfaces; and at least one conductive resonator element configured on one of the surfaces of the at least one dielectric slab, said conductive element having a crescent shape including a center portion and opposing end portions defining a gap therebetween, wherein the center portion has a wider dimension than the end portions so that a width of the element gradually tapers from the center portion to the end portions, said conductive element having a diameter that is a fraction of a wavelength of a center frequency of the frequency band, and wherein the at least one conductive element is configured on the at least one surface of the slab so that an outer edge of the conductive element aligns with an outer edge of the slab.

3. The structure according to claim 2 wherein the at least one dielectric slab is a ceramic.

4. The structure according to claim 2 wherein the at least one dielectric slab includes a plurality of different dielectric layers.

5. The structure according to claim 2 wherein the at least one dielectric slab has a thickness that is less than a wavelength of the frequency band.

6. The structure according to claim 2 wherein the at least one dielectric slab has a thickness in the range of 5-200 μm.

7. The structure according to claim 2 wherein the diameter of the conductive element is between ⅛ and 1/20 of a wavelength of the center frequency of the frequency band.

8. The structure according to claim 2 wherein the opposing end portions have rounded ends.

9. The structure according to claim 2 wherein the at least one dielectric slab is a plurality of dielectric slabs each including a respective conductive resonator element configured on a surface of the corresponding dielectric slab so as to define a stack of the slabs, wherein each slab and each conductive element has a different size so that each conductive element resonates at a different frequency band.

10. The structure according to claim 9 wherein the plurality of dielectric slabs are configured so that a largest size dielectric slab is positioned at a bottom of the structure and the slabs decrease in size to a top of the structure.

11. The structure according to claim 10 wherein a plurality of the stacked slabs are configured adjacent to each other as an array so that a two-dimensional width of the array is about two times a wavelength of the frequency band.

12. The structure according to claim 2 wherein the structure is a waveguide and the at least one slab is a plurality of slabs positioned adjacent to each other, where each slab includes four conductive resonator elements positioned on outer surfaces of the waveguide.

13. The structure according to claim 12 wherein two of the four conductive elements are positioned on two opposing walls of the waveguide and the other two conductive elements are positioned on two other opposing side walls of the waveguide.

14. A metamaterial resonator structure having a size for resonating a predetermined frequency band, said structure comprising:

a plurality of dielectric slabs each having a top surface and a bottom surface defining a thickness there between and each defining a unit cell of the structure; and a plurality of conductive resonator elements where each conductive element is configured on the top surface of the corresponding dielectric slabs, each conductive element having a crescent shape including a center portion and opposing end portions defining a gap there between, wherein the center portion has a wider dimension than the end portions so that a width of the element gradually tapers from the center portion to the end portions, and wherein each unit cell resonates at a different portion of the predetermined frequency band.

15. The structure according to claim 14 wherein the opposing end portions have rounded ends.

16. The structure according to claim 14 wherein the dielectric slabs have a thickness that is less than a wavelength of the frequency band.

17. The structure according to claim 14 wherein a diameter of the conductive elements is between ⅛ and 1/20 of a wavelength of a center frequency of the frequency band.

18. The structure according to claim 14 wherein the plurality of dielectric slabs are configured so that a largest size dielectric slab is positioned at a bottom of the structure and the slabs decrease in size to a top of the structure.

* * * * *